United States Patent [19]

Ruda

[11] 3,974,958

[45] Aug. 17, 1976

[54] HEADER BAG

[75] Inventor: Raymond J. Ruda, Chicago, Ill.

[73] Assignee: Bagcraft Corporation of America, Chicago, Ill.

[22] Filed: Oct. 9, 1974

[21] Appl. No.: 513,287

[52] U.S. Cl. ..... 229/55; 93/35 R; 229/62

[51] Int. Cl.[2] ..... B65D 33/02

[58] Field of Search ..... 206/806; 229/55, 62; 93/35 R; 156/220, 227, 306

[56] References Cited

UNITED STATES PATENTS

| | | | |
|---|---|---|---|
| 2,757,957 | 8/1956 | Samann | 206/806 X |
| 2,969,907 | 1/1961 | Hubert | 229/55 |
| 2,971,874 | 2/1961 | Canno | 206/806 X |
| 3,096,013 | 7/1963 | Kugler | 229/55 |
| 3,300,120 | 1/1967 | McColgan | 229/55 |
| 3,554,435 | 1/1971 | Martinez | 229/55 |
| 3,722,786 | 3/1973 | Honn et al. | 229/62 X |
| 3,829,007 | 8/1974 | Ellison | 229/55 |
| 3,844,409 | 10/1974 | Bodolay et al. | 229/55 X |

*Primary Examiner*—Stephen P. Garbe
*Attorney, Agent, or Firm*—Hill, Gross, Simpson, Van Santen, Steadman, Chiara & Simpson

[57] ABSTRACT

A header bag is made from a web of flexible thermoplastic sheet having a prospective header portion which comprises a selected number of folds of the plastic sheet that are heat-laminated together, the header portion having a heat-embossed stiffening pattern thereon.

6 Claims, 10 Drawing Figures

HEADER BAG

BACKGROUND OF THE INVENTION

1. Field of the Invention

This invention relates to flexible plastic bags having a stiffer header portion.

2. Prior Art

It is conventional to use a header bag for displaying merchandise which frequently is hung on a rack utilizing a hook. A typical header bag is made of a soft, pliable material such as a plastic polyethylene or the like. To support the merchandise and keep the plastic bag from drooping, a stiffening material strip is added to the bag. Usually the stiffening strip is a piece of cardboard or heavier paper glued or stapled to the bag, or the cardboard is coated to enable it to be heat sealed to the thermoplastic bag material. In some forms, the cardboard is cut shorter than the width of the bag and the bag material is heat sealed around it. All these types of construction require special bag-making machinery and cardboard handling equipment and the like.

SUMMARY OF THE INVENTION

According to the invention, the header portion is formed by having the flexible thermoplastic sheet material folded over upon itself a selected number of times to provide the number of layers of the bag material that are needed for a particular application, such number of layers being optionally augmented, and all the layers being heat-laminated together and having a heat-embossed stiffening pattern.

Accordingly, it is an object of the present invention to provide a header bag without having any cardboard insert.

A further object of the present invention is to provide a construction for a header bag that can be produced more efficiently and more economically than those having cardboard inserts.

A still further object of the present invention is to provide a header bag using only flexible thermoplastic sheet material.

Yet another object of the present invention is to provide a header bag construction which can be constructed without use of any special bag making machine and to that end uses no cardboard stiffeners, adhesives or the like, but utilizes only the original bag material or additional thermoplastic material and heat for fabrication.

Many other advantages, features and additional objects of the present invention will become manifest to those versed in the art upon making reference to the detailed description and the accompanying sheets of drawings in which a preferred structural embodiment incorporating the principles of the present invention is shown by way of illustrative example.

ON THE DRAWINGS

AS SHOWN ON THE DRAWINGS

Figure 1:
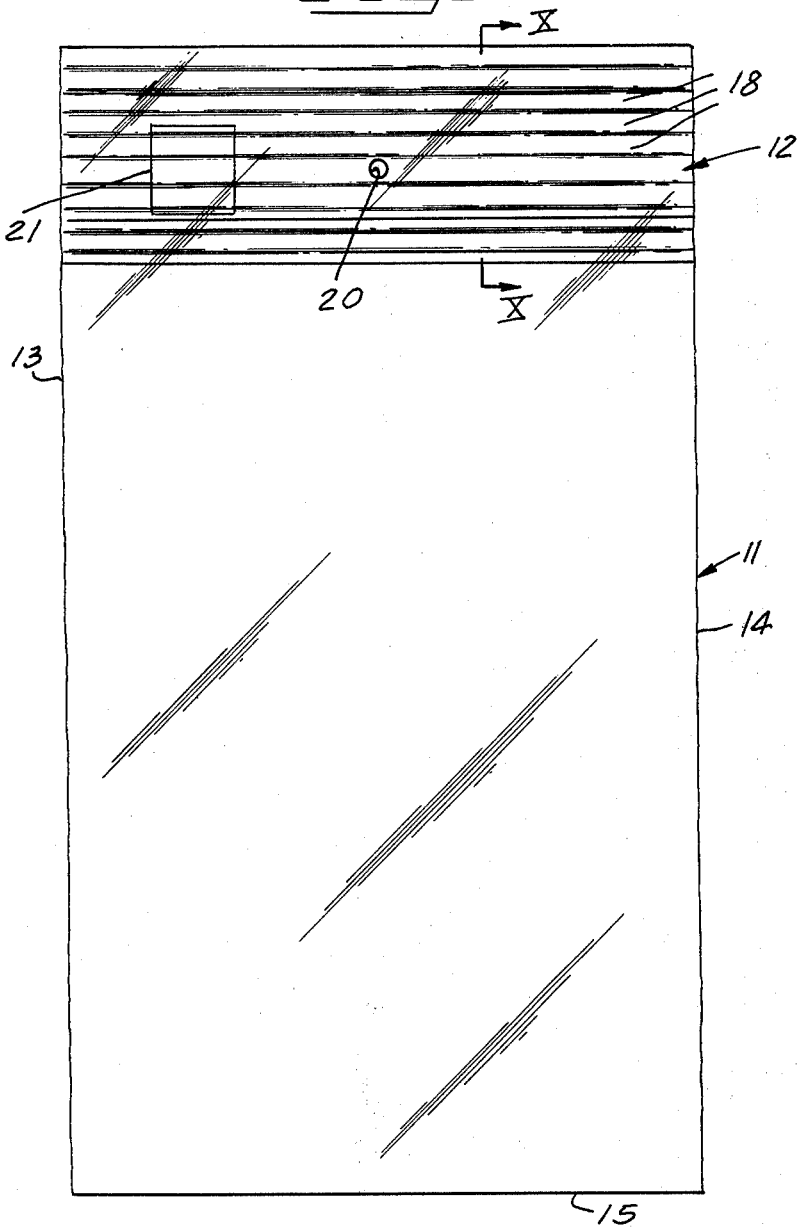
FIG. 1 is an elevational view of a header bag provided in accordance with the invention.

A header bag is shown in FIG. 1 indicated generally by the numeral 11. The bag 11 has an embossed laminated header portion 12, a pair of heat-sealed longitudinal edges 13, 14 and an open bottom end 15 through which the bag is filled and which is thereafter heat sealed.

Figure 2:
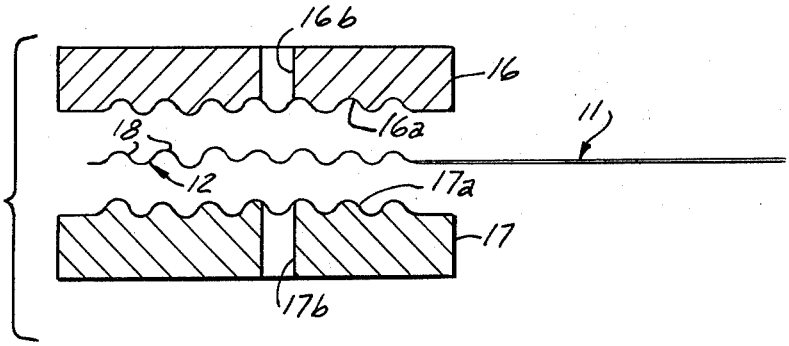
FIG. 2 is a diagrammatic illustration of the method and means used for fabricating the header portion of the bag of FIG. 1.

The bag 11 is fabricated from a web of flexible thermoplastic sheet material such as polyethylene with the web so folded along its length that the edges thereof are aligned with each other to define the open bottom end 15 of the finished bag. An intermediate portion of the web is thus folded upon itself at the folded end to provide at least two layers of the sheet material which are subjected to heated means 16, 17 (FIG. 2) which have a stiffening pattern 16*a*, 17*a* by which the layers of thermoplastic material are heat-laminated together, the pattern 16*a*, 17*a* providing a heat-embossed pattern that is arranged to stiffen the header portion 12. In this embodiment, the stiffening pattern comprises a series of horizontal corrugations 18. When the header portion 12 is still molten or soft, an appropriate tool or gas is inserted through one of a pair of openings 16*b*, 17*b* in the heated means 16, 17 to provide an aperture 20 in the header portion 12 for supporting the bag 11 with the corrugations 18 extending horizontally. If desired, the flexible thermoplastic sheet material or web can be imprinted prior to its having been folded, and preferably any such imprinting is on one of the inner sides of the layers that make up the prospective head portion 12. Imprinting is shown in simplified form at 21.

If desired, the heated means 16, 17 can comprise portions of complemental rollers between which the web passes in the direction of the corrugations, with increments of the web thus folded and laminated being severed as by a hot wire or knife to form the heat sealed edges 13, 14.

Where a rather flimsy or flexible thermoplastic sheet material is used for the web, the header portion 12 will increase its stiffness, at least sufficiently for lightweight contents. However, as the mass of contents to be supported by the header portion 12 increases, the amount of stiffness thereof must be selectively increased. One manner of doing this is to increase the thickness of the thermoplastic sheet material chosen. However, it is preferable according to the present invention to supplement the stiffness of the web without changing the thickness of the web material so that one supply of web material can be used in the manufacture of bags of various header stiffness.

Figure 3:
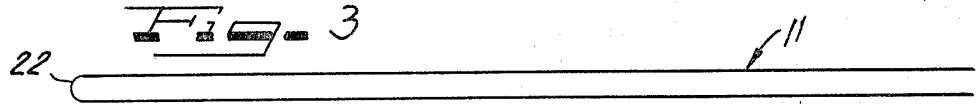
FIGS. 3–10 diagrammatically, in enlarged scale, illustrate a number of ways of folding the prospective header end of the bag before it is heat-laminated together as shown in FIG. 2.
Figure 4:
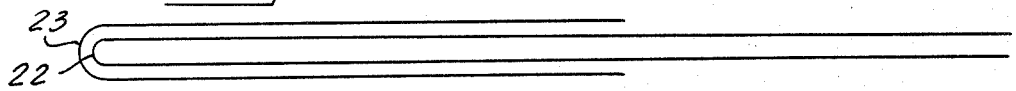

FIGS. 3–10 in enlarged form are all taken along the line X—X on FIG. 1 and illustrate a number of modes of selectably increasing the stiffness of the header portion 12 from that which would be obtained where a single fold 22 is used as shown in FIG. 3. In each of FIGS. 4, 7, 8 and 10, there is shown a flexible thermoplastic cap strip 23 which extends about the folded end of the bag material and is automatically fed in the bag making machine to the relative position shown diagrammatically. The strip 23 thus comprises two additional layers of flexible thermoplastic sheet material which form a part of the heat-laminated heat-embossed header portion 12. Thus as shown in FIG. 4, at least four layers make up the header portion 12 before they are fused together.

Figure 5:
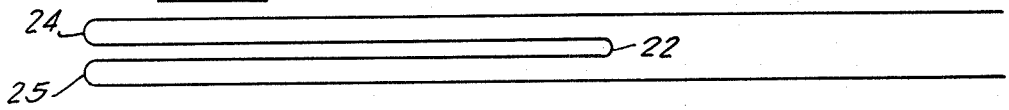
Figure 6:
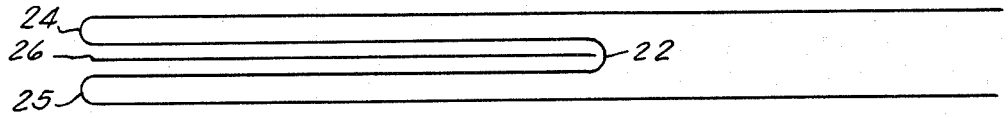
Figure 7:
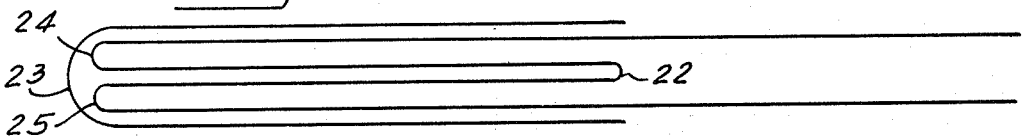
Figure 8:
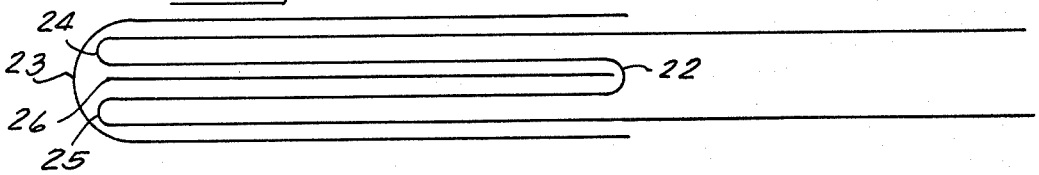

Two types of refolding the folded end portion are shown in FIGS. 5 and 6. In FIG. 5, the folded edge 22 is inturned between the sides of the bag by an amount corresponding to the extent of the header portion 12 to provide a sort of W shaped cross section having additional folded edges 24, 25, thus also providing at least four layers of sheet material in the prospective header portion 12. As shown in each of FIGS. 6 and 8, a thermoplastic insert strip 26 may be utilized to provide one additional layer in the header portion 12, in these forms, the insert strip 26 being placed between the legs of the W formation. Each insert strip 26 is an additional layer that forms part of the heat-laminated heat-embossed header portion 12.

Figure 9:
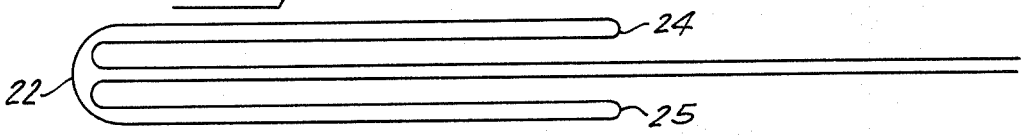
Figure 10:
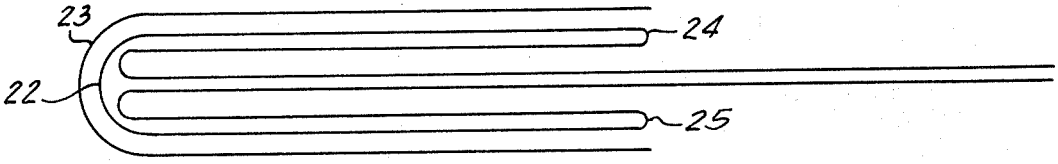

Another form of refolding is shown in FIGS. 9 and 10. The point 22 on the web in FIG. 3 is convex, and the same point 22 on the web in FIG. 5 is concave. If one takes the structure of FIG. 5 and folds the legs of the W portion back upon the sides of the bag, then the point 22 again becomes convex as shown in FIG. 9 and by the mode of refolding shown in FIGS. 9 and 10, at least six layers are provided.

Collectively, FIGS. 3–10 show a number of ways of folding the folded or header end 12 of the bag 11 wherein the central portion of the web provides the material for the folds which may have a single fold as shown in FIG. 3, one refold as shown in FIG. 5 and two refolds as shown in FIG. 9, any one of which may be augmented by one or more of the cap strips 23 and one or more of the thermoplastic insert strips 26. Whatever number of layers is needed to obtain the necessary stiffness for a particular application, for a particular bag size, and for a particular thickness of bag material can thus be readily selected, and a wide variety of stiffnesses of the header portion can be produced as selected. Thus the bag construction can be altered for any width of bag, any weight of article, any stiffness of article, any gauge of the polyethylene sheet material. Only a hot wire cutoff need be used, and no shearing knife needs to be used on the header portion as is the case of prior art constructions. Other forms of stiffening pattern will no doubt be suitable. However, the corrugations disclosed are particularly desirable because the bags nest well on top of one another and thus stack better in their pre-filled handling.

Although various minor modifications may be suggested by those versed in the art, it should be understood that I wish to embody within the scope of the patent warranted hereon all such embodiments as reasonably and properly come within the scope of my contribution to the art.

I claim as my invention:

1. A header bag consisting of only thermoplastic sheet material and comprising a web of flexible thermoplastic sheet material folded over upon itself and having heat-sealed longitudinal edges extending transversely to the fold at opposite sides of the bag, the folded end of the bag having a header portion extending in the direction of the length of said web and comprising at least two layers of said material heat laminated together throughout the entire header portion to the end of the bag, there being a heat-embossed stiffening pattern throughout said heat-laminated portion by which portion the flexible bag, when filled, can be supported, said stiffening pattern comprising an area of embossed corrugations extending parallel to the fold, there being imprinting on the web material within said header portion visible through the embossed material, said header portion having an aperture formed while the material thereof was molten during heat-lamination.

2. A header bag according to claim 1 having a cap strip of flexible thermoplastic sheet material folded about the fold on opposite sides of the bag and forming added laminated layers of sheet material of said heat-laminated header portion.

3. A header bag according to claim 1 in which the folded edge is refolded to provide at least six layers of said material laminated together in one stack in said heat-laminated header portion.

4. A header bag consisting of only thermoplastic sheet material and comprising a web of flexible thermoplastic sheet material folded over upon itself and having heat-sealed longitudinal edges extending transversely to the fold at opposite sides of the bag, the folded end of the bag having a header portion extending in the direction of the length of said web and comprising at least two layers of said material heat laminated together throughout the entire header portion to the end of the bag, there being a heat-embossed stiffening pattern throughout said heat-laminated portion by which portion the flexible bag, when filled, can be supported, said stiffening pattern comprising an area of embossed corrugations extending parallel to the fold, the folded edge having been inturned between the bag sides, the resulting two-layer portions having been thereafter folded at said folded edge, said folding providing two 2-layer portions respectively lying on opposite sides of the bag to provide a header portion with at least six layers laminated together in one stack.

5. A header bag consisting of only thermoplastic sheet material and comprising a web of flexible thermoplastic sheet material folded over upon itself and having heat-sealed longitudinal edges extending transversely to the fold at opposite sides of the bag, the folded end of the bag having a header portion extending in the direction of the length of said web and comprising at least two layers of said material heat laminated together throughout the entire header portion to the end of the bag, there being a heat-embossed stiffening pattern throughout said heat-laminated portion by which portion the flexible bag, when filled, can be supported, said stiffening pattern comprising an area of embossed corrugations extending parallel to the fold, the folded edge having been refolded to provide at least four layers of said material in said heat-laminated header portion, there being an added thermoplastic insert strip of sheet material disposed between and laminated to originally external surfaces of said heat-laminated header portion.

6. A method of making a plastic bag of the header type consisting only of thermoplastic sheet material, comprising:

a. folding a web of flexible thermoplastic material upon itself with a selected even number of layers of said bag material in juxtaposition with each other to define a prospective header portion;

b. adding a selected number of layers of other flexible thermoplastic sheet material against an external surface of the prospective header portion; and c. thereafter laminating all the layers of said header portion together by use of heated means which imparts an embossed stiffening pattern of corrugations throughout the area of the header portion, the corrugations extending continuously in the direction of the length of the web.

* * * * *